US011667989B2

(12) United States Patent
Da Costa et al.

(10) Patent No.: US 11,667,989 B2
(45) Date of Patent: Jun. 6, 2023

(54) METALLIC ORE PELLETS

(71) Applicant: S. A. Lhoist Recherche et Developpement, Ottignies-Louvain-la-Neuve (BE)

(72) Inventors: Eduardo Da Costa, Angleur (BE); Marc Pelletier, Saint-Mande (FR)

(73) Assignee: S. A. Lhoist Recherche et Developpement, Ottignies-Louvain-la-(BE)

( * ) Notice: Subject to any disclaimer, the term of this patent is extended or adjusted under 35 U.S.C. 154(b) by 780 days.

(21) Appl. No.: 16/464,511

(22) PCT Filed: Nov. 30, 2017

(86) PCT No.: PCT/EP2017/080986
§ 371 (c)(1),
(2) Date: May 28, 2019

(87) PCT Pub. No.: WO2018/100064
PCT Pub. Date: Jun. 7, 2018

(65) Prior Publication Data

US 2020/0190623 A1 Jun. 18, 2020

(30) Foreign Application Priority Data

Nov. 30, 2016 (WO) ..... PCT/EP2016/079338

(51) Int. Cl.
*C22B 1/243* (2006.01)
*C22B 1/24* (2006.01)

(52) U.S. Cl.
CPC ..... *C22B 1/243* (2013.01); *C22B 1/2406* (2013.01)

(58) Field of Classification Search
CPC ..... C22B 1/2406; C22B 1/2413; C22B 1/243; C22B 5/22; C22B 9/00
USPC ..... 75/773
See application file for complete search history.

(56) References Cited

U.S. PATENT DOCUMENTS

| | | | | |
|---|---|---|---|---|
| 4,093,448 | A * | 6/1978 | Eliseev | C22B 1/2406 75/768 |
| 2002/0175441 | A1* | 11/2002 | Tsuchiya | C21B 13/0046 264/118 |
| 2005/0061207 | A1* | 3/2005 | Liu | C22B 1/245 106/713 |
| 2006/0105901 | A1 | 5/2006 | Stein et al. | |
| 2016/0115076 | A1* | 4/2016 | Criniere | C01F 11/02 106/459 |

FOREIGN PATENT DOCUMENTS

| | | | |
|---|---|---|---|
| EP | 1659190 | A2 | 5/2006 |
| FR | 3008405 | A1 | 1/2015 |
| GB | 990672 | A | 4/1965 |
| UA | 30581 | A | 12/2000 |
| UA | 84871 | C2 | 12/2008 |

OTHER PUBLICATIONS

PCT/EP2017/080986, International Search Report, 3 pages, dated Feb. 27, 2018, European Patent Office.

* cited by examiner

*Primary Examiner* — Jie Yang
(74) *Attorney, Agent, or Firm* — Whitaker Chalk Swindle & Schwartz PLLC; Charles Gunter

(57) ABSTRACT

The present invention concerns the use of a magnesium-including compound as binder for producing metallic ore fluxed pellets, in particular iron ore fluxed pellets, said magnesium-including compound comprising semi-hydrated dolime fitting the general formula $aCa(OH)_2 \cdot bMg(OH)_2 \cdot cMgO$, a, b, and c being weight fractions wherein the weight fraction b of $Mg(OH)_2$ is between 0.5 and 19.5 % by weight with respect to the total weight of said semi-hydrated dolime.

8 Claims, No Drawings

METALLIC ORE PELLETS

FIELD OF THE INVENTION

The present invention relates to metallic ore fluxed pellets, in particular iron ore fluxed pellets.

BACKGROUND OF THE INVENTION

According to the present invention, it is meant by the terms "metallic ore fluxed pellets", pellets made from metallic ore coming from metal ore mines. The term "metallic" is a general term which includes the ferrous, also called iron, and the non-ferrous metal ore. The non-ferrous metal ore commonly contains metals such as chromium, manganese, nickel, lead, tin, copper, etc.

The iron (ferrous) ore mainly contains iron, about 60% by weight or above, but may also contain other metals such as titanium and manganese in combination with iron.

Metallic ore pellets are produced from fine metallic concentrate containing at least 60% by weight of metals. Metallic ore concentrate, also simply called concentrate, is the product obtained by finely grinding raw ore in a grinding operation after which the gangue (impurities) is removed. The resulting product is therefore a concentrate of metal component. The remaining impurities which can be present in the concentrate are for example silicates, aluminates, phosphates, sulphates.

Iron ore pellets are made from magnetitic, hematitic, limonitic sideritic concentrates containing at least 60% by weight of iron.

The fine metallic concentrate is firstly granulated in a vessel (container) like a drum or a disk (pan) during a balling process, to form the so-called green pellets which are in fact crude pellets. These green pellets are then hardened by heating in an induration furnace which is typically divided in three zones; the drying zone at about 300° C., the firing zone at about 1300° C. and the cooling zone. After the hardening process, the pellets may be called fired pellets and are suitable for handling in bulk and charging into a metallurgical reactor, for example a blast furnace (shortened BF) or a direct reduction reactor (shortened DR), the direct reduction reactor being used before an electric are furnace in a plant.

It is known to use naturally available minerals, such as olivine, dunite, pyroxenite, limestone or dolomite, as fluxes, also called fluxing agents, to improve the metallurgical properties of the fired pellets. It is indeed known that the properties and the chemical composition of the green pellets have an impact on the quality of fired pellets when used in metallurgical reactor. The metallic ore pellets containing fluxes are also called metallic ore fluxed pellets or just fluxed pellets. The properties of the fluxed pellets depend on the nature of the above fluxes which are physically and chemically different and which contain different types and quantities of gangue materials, such as silica and/or alumina, etc. which are considered as impurities in the pellets.

In the production of fluxed pellets, carbonates and/or silicates are commonly used. Carbonates present the disadvantage for the pellet producer of consuming energy for their calcination, as well as the emission of carbon dioxide. In the production of calcitic fluxed pellets, the use of calcium carbonate (limestone) as flux is common. In the production of magnesian fluxed pellets, magnesium silicate, like olivine or pyroxenite has been privileged as the flux.

Binders are used in the production of fluxed pellets in order to allow the formation of the green pellets by balling and then withstand the mechanical and thermal stresses of the handling in their production process in particular in the induration furnace (in the drying, firing and cooling zones).

Bentonite, a type of clay, has been the binder of choice since the inception of the production of metallic ore fluxed pellets. An existing alternative to the bentonite is the use of organic binders like those based on carboxymethylcellulose or polyacrylamide, which are however more expensive and hinder the achievement of good mechanical properties in the final pellets.

The present invention aims at focusing on the use of alternative binders for the manufacturing of metallic ore fluxed pellets, in particular iron ore fluxed pellets.

The document of J. Pan et al. relates to the production in laboratory of calcitic fluxed pellets made from the mix of pre-treated iron fine ore, binder and limestone as fluxes (see Iron Ore conference/Perth, Wash., 11-13 Jul. 2011, J Pan, D Q Zhu, M Emrich, T J Chun and H Chen, "Improving the fluxed pellets performance by hydrated lime instead of bentonite as binder"). The binders which are compared in this document are bentonite and hydrated lime and the mechanical properties of the resulting fluxed pellets are analysed. This document concludes that the replacement of bentonite by hydrated lime as binder improves the physical properties and the compressive strength of fired pellets and also plays a role in improving the metallurgical performance of fired pellets.

However, this document also discloses that in order to observe this improvement in the compressive strength of the fired pellets in the presence of hydrated lime, the preheating temperature during the induration process of the green pellets has to be controlled and brought up to 1100° C. Indeed, the compressive strength of the fired pellets made from preheated pellets with bentonite is higher than the one of those made from preheated pellets containing hydrated lime when the preheating temperature was less than 1050° C.

The document of Cribbes and Kestner (see Research Engineer, Dravo Corporation, Pittsburgh, Pa., Chapter 16, pages 272-285, 1977 "Some factors influencing iron ore fired pellet quality" by James D. Cribbes and Daniel W. Kestner) shows that it is possible to use hydrated lime as a substitute for limestone as flux and for bentonite as binder and still obtain pellets presenting reasonable physical properties. In this document, fluxed pellets containing bentonite and hydrated lime are compared to fluxed pellets containing only hydrated lime. They noticed that, at the optimum balling moisture for pellets containing bentonite plus limestone, the pellets made only with hydrated lime produce, after the hardening process, fired pellets having a fuzzy, uneven surface. They also found out that it is necessary to reduce the green pellet moisture for pellets containing only hydrated lime in comparison with the pellets containing bentonite, to obtain fired pellets presenting a good fired strength after the hardening process. These results showed that the control of the balling parameters such as moisture of the green pellets is more difficult with the use of hydrated lime as flux and binder and that properties of the green pellets when not well controlled can have an impact on the quality of fired pellets.

The document of Gielen relates to the industrial production of pellets made from hematitic concentrate (see Society of mining engineers of aime, Colorado, 1983, "Quality improvements and energy savings in iron ore pelletizing" by H. H. Gielen, H. S. Heep, M. R. Hohensee, H. G. Papacek, V. V. Arnim). In this document, they stated that hydrated lime is by no means a good substitute for bentonite as a binder in fluxed pellets. Green pellets containing hydrated lime as a binder had a strong tendency to stick, causing a lot of difficulties with clogged screen decks. They highlighted that, with improvements achieved in the filter section (filter cake) during a filtration step of the fine concentrates and at the same time a partial substitution of hydrated lime by limestone in the composition of the green pellets, the difficulties during the balling step were reduced.

Because of the difficulties above mentioned encountered when other binders than bentonite have been tested, over time, bentonite turned out to be the binder of choice in the production of fluxed pellets notably because it enhances the balling process by controlling the moisture content of the green pellets. Indeed, the balling process and more precisely the baiting rate is, amongst others, controlled by the moisture content of the raw mixture used to produce green pellets. Bentonite has been found to more easily regulate the moisture content during the balling process.

However, although bentonite seems to be inescapable for producing metallic fluxed pellets with good physical properties, it presents the drawback of bringing more impurities, mainly silica and alumina, to the green pellets. These impurities withstand the induration process and can be found in the fired pellets. The addition of impurities such as silica or alumina to the fired pellets causes thereafter the increase of the amount of slag in the metallurgical furnace (notably the blast furnace or the electric arc furnace) which is not desirable.

The present invention further relates to metallic ore fluxed pellets, in particular iron ore fluxed pellets containing magnesium-including compound as binder.

By the terms "magnesium-including compound", it is meant in the present invention, a compound based on magnesium such as magnesium hydroxide, calcium magnesium tetra hydroxide, calcium magnesium (di)hydroxide oxide and mixtures thereof.

Further, the basicity of the fired pellets has to be controlled by controlling the fraction between Ca and/or Mg compounds (expressed as oxides CaO and/or MgO) on the one side and $SiO_2$ and/or $Al_2O_3$ on the other side. The quantity of these compounds is however governed by the chemical composition of the green pellets which is itself controlled by the composition of the compounds initially used for producing them.

Metallic fluxed pellets have to fulfill critical criteria to be used in metallurgical reactors, such as blast furnace or direct reduction reactor. The mechanical and metallurgical properties of the fired pellets need to be adequate, for example, for avoiding decrepitation or swelling at high temperatures inside the metallurgical reactor.

The green (crude) pellets also have to present adequate physical properties to resist to the hardening process without being degraded by the increase of foe temperature and the compression constraints into the induration furnace.

In addition to this, it is important to control the moisture of the green fluxed pellets. The ratio between the solid components and the water added during the balling process is crucial for having pellets with the right size, as well as presenting a good behavior in the next steps of the process, especially inside the induration furnace. The ratio between the different components in the starting powdered composition are therefore crucial for processing green pellets presenting the appropriate physicochemical properties during the induration process as well as later on in the form of fired pellets, inside the metallurgical reactors.

Moreover, actually, notably due to the impoverishment of metallic ore, it is also quite often required being able to process green pellets starting from metallic concentrate in the form of a slurry (i.e. a suspension, in particular an aqueous suspension) of metallic concentrate. The control of the moisture content during the balling process is therefore in this case much more challenging.

On the other hand, the resulting fired pellets have also to present satisfactory physical and metallurgical properties to be used afterwards in metallurgical reactors.

The physical properties are essential for example because breakage and abrasion of the fired pellets lead to the loss of material during their storage and transportation. Moreover, it is preferable for the fired pellets to present a good mechanical strength, also called crushing or compressive strength, in order to avoid any loss of permeability in the metallurgical reactor when charged into it. The mechanical strength of the pellets can be measured, for example by the ISO standard 4700, "Determination of the crushing strength".

The metallurgical qualities of the fired pellets are also an important criterion which is characterized by the reducibility, the swelling and the low temperature breakdown of the fired pellets, notably according to the ISO standard 7215, "Determination of the reducibility by the final degree of reduction index" or according to standard ISO 4695 "Determination of the reducibility by the rate of reduction index", the ISO standard 4698, "Determination of the free-swelling index" and the ISO standard 4696 "Determination of low-temperature reduction-disintegration indices by static method".

Document J. Pan et al. which has been cited previously (see Iron Ore conference/Perth, Wash., 11-13 Jul. 2011, J Pan, D Q Zhu, M Emrich, T J Chun and H Chen, "Improving the fluxed pellets performance by hydrated lime instead of bentonite as binder" also mentions that in producing fluxed pellets, MgO content significantly affects the firing performance of fluxed pellets and higher MgO content leads to a lower compressive strength of the fired pellets made from preheated pellets (see Zhang, 2009 and Wang, Liu and Chen, 2004).

Although, it has been found that 0.9% pure MgO in pellet can reduce the reduction degradation index (RDI) to as low as 7.5%, it also shows a deterioration in compressive strength of the fired pellets (see Transactions of the Indian Institute of Metals, August 2016, Volume 69, Issue 6, pp 1141-1153, Role of MgO and its Different Minerals on Properties of Iron Ore Pellet, Md. Meraj, Susanta Pramanik, Jagannath Pal.). This document states that when adding magnesium additives, the strength of the fired pellets will be decreased because of the oxidation of magnetite which is delayed by the presence of MgO in the pellets.

Other fluxes based on MgO have been tested and provide good strength properties at lower induration temperature but cannot reduce degradation index to sufficiently low level.

In view of these sensitive requirements, it is not easy to modify the composition of metallic ore fluxed pellets without completely disrupting the sensible physicochemical properties of the green and the fired pellets. Because the quality of the fired pellets depends on the properties of the green pellets, it is also necessary to control the quality of the green pellets for obtaining adequate fired pellets suitable for use in metallurgical furnaces.

Despite its drawbacks, bentonite is at the moment recommended to achieve all the above mentioned requirements essential to obtain adequate metallic fluxed pellets suitable for withstanding an induration process when in the form of green pellets and thereafter for use in direct reduction reactors or blast furnaces when in the form of fired pellets.

However, there is still a need to provide alternative metallic ore fluxed pellets, in particular iron ore fluxed pellets presenting controlled basicity, controlled moisture and enhanced mechanical and metallurgical properties while reducing the volume of slag in the metallurgical furnace.

SUMMARY OF THE INVENTION

To this end, the invention provides the use of a magnesium-including compound as binder for producing metallic ore fluxed pellets, in particular iron ore fluxed pellets characterized in that the magnesium-including compound comprises semi-hydrated dolime or dolomitic lime fitting the general formula $aCa(OH)_2 \cdot bMg(OH)_2 \cdot cMgO$, a, b, and c being weight fractions wherein the weight fraction b of $Mg(OH)_2$ is between 0.5 and 19.5% by weight with respect to the total weight of said semi-hydrated dolime.

This compound is a dolomite or dolomitic limestone derivative, which will be called a semi-hydrated dolime in the present invention, obtained by calcination and then by partial hydration (slaking with water) of a natural dolomite or dolomitic limestone.

The semi-hydrated dolime may therefore contain the same impurities than those of the dolomite from which it is produced.

Semi-hydrated dolime according to the present invention may so contain impurities, such as sulphur oxide, $SO_3$, silica, $SiO_2$ or even alumina, $Al_2O_3$, the sum of which being at a level of some weight %. The impurities are expressed herein under their oxide form, but of course, they might appear as different minerals. Semi-hydrated dolime contains generally also some weight % (up to 10%) of residual unburned residues, namely magnesium and/or calcium carbonates, $MgCO_3$ and/or $CaCO_3$ (usually essentially $CaCO_3$). In some cases, some unreacted (not slaked) calcium oxide CaO might appear at a level of 1% by weight or less.

As may be seen, the present invention describes the use not of physical mixtures but actually of a single compound providing both magnesium and calcium compounds, namely $Mg(OH)_2$, $Ca(OH)_2$ and MgO. The use of a single compound instead of physical mixtures of multiple compounds has a considerable practical advantage, since the method for producing the pellets will be easier when a single binder is used instead of several ones. Further, the homogeneity of the dispersion of the Ca and Mg compounds in the composition of the pellets is also improved when both of these components are provided via a single binder, itself perfectly homogenous.

On the other hand, it has the advantage, as compared with completely hydrated dolomite, of being a product which is much easier to obtain. Indeed, totally hydrated dolomite, which may be represented by a weight formula of the type $xCa(OH)_2 \cdot yMg(OH)_2$ and containing non-hydrated residues CaO and/or MgO only in trace amounts (less than 1%) is difficult to obtain, since it requires complete hydration of calcined dolomite, generally carried out under pressure up to 1 MPa (10 bars) and high temperature, up to 180° C. The totally hydrated dolomite of general formula $xCa(OH)_2 \cdot yMg(OH)_2$ therefore remains at the present time a specialty product.

In the present invention, semi-hydrated dolime is used as a binder in order to let the metallic ore fluxed pellets to be formed properly and to withstand the induration process, giving afterwards fired pellets of good quality, meaning having good mechanical and metallurgical properties.

Indeed, it has been surprisingly observed in the present invention that it is possible to replace the commonly used binder, namely bentonite, by a binder composed of semi-hydrated dolime containing between 0.5 and 19.5% by weight of $Mg(OH)_2$ without degrading the physicochemical properties of the metallic ore fluxed pellets, against all expectations.

In the semi-hydrated dolime used as binder in the present invention, the proportion of $Mg(OH)_2$ is maintained between 0.5 and 19.5% by weight in order to control the moisture content of the composition during the process of production of green pellets and to enhance the mechanical properties of the resulting green pellets.

Advantageously, the weight fraction b of $Mg(OH)_2$ is higher than or equal to 1%, in particular higher than or equal to 1.5%, most particularly higher than or equal to 2%, preferably higher or equal to 5% and lower than or equal to 18%, in particular lower than or equal to 15% by weight with respect to the total weight of said semi-hydrated dolime.

It has been demonstrated in the present invention that it is possible to fully replace bentonite or any organic product as a binder and olivine (or other silicate) as a flux with semi-hydrated dolime.

Another advantage of the use of semi-hydrated dolime as a binder leads to a decrease in the consumption of carbonates as a flux, if they are used, causing a decrease in the $CO_2$ emissions during the induration process.

Moreover, when the semi-hydrated dolime according to the present invention is replacing silicates-including compounds, it allows the reduction of the slag-rate in the blast-furnace.

Preferably, according to the present invention, the weight ratio of said binder is between 0.5% and 5%, preferably between 0.5% and 1.5% by weight with respect to the total weight of the pellets.

Alternatively, according to the present invention, the weight fraction of semi-hydrated dolime is between 80% and 100%, preferably between 90% and 100%, more preferably between 95% and 100%, advantageously between 97% and 100%, preferably between 98% and 100% by weight with respect to the total weight of the binder. In a particular embodiment of the invention, the semi-hydrated dolime is 100% by weight with respect to the total weight of the binder.

Advantageously, the weight fraction c of MgO is greater than or equal to 5%, preferably greater than or equal to 10%, advantageously greater than or equal to 15%, preferentially greater than or equal to 20% by weight of MgO with respect to the total weight of said semi-hydrated dolime and is less than or equal to 41%, preferably less than or equal to 30% by weight of MgO with respect to the total weight of said semi-hydrated dolime.

In this particular embodiment of the invention, if higher MgO contents are envisaged, magnesium oxide can be added as a complementary flux. More preferably, the weight fraction a of $Ca(OH)_2$ is greater than or equal to 15%, preferably greater than or equal to 30%, advantageously greater than or equal to 40%, preferentially greater than or equal to 45% by weight of $Ca(OH)_2$ with respect to the total weight of said semi-hydrated dolime and is less than or equal to 85%, preferably less than or equal to 65%, advantageously less than or equal to 60%, more preferably less than or equal to 55% by weight of $Ca(OH)_2$ with respect to the total weight of said semi-hydrated dolime.

Preferably, the semi-hydrated dolime is in a powdery form.

Alternatively, the semi-hydrated dolime is in the form of an aqueous suspension of said compound based on said semi-hydrated dolime.

Moreover, in a particular embodiment, the semi-hydrated dolime comprises particles presenting BET specific surface area obtained from nitrogen adsorption comprised between 5 and 25 $m^2/g$, in particular between 10 $m^2/g$ and 20 $m^2/g$.

DETAILED DESCRIPTION OF THE INVENTION

By the term "particles" in the sense of the present invention, it is meant the smallest solid discontinuity of the mineral filler which may be observed with a scanning electron microscope (SEM).

By the expression "BET specific surface area", it is meant in the meaning of the present specification the specific surface area measured by manometry with adsorption of nitrogen at 77 K after degassing under vacuum at a temperature comprised between 150 and 250° C., notably at 190° C. for at least 2 hours and calculated according to the multipoint BET method as described in the ISO 9277:2010E standard.

Advantageously, the semi-hydrated dolime comprises particles presenting a total BJH pore volume consisting of pores with a diameter lower than 1000 Å, obtained from nitrogen desorption comprised between 0.05 and 0.15 $cm^3/g$.

By the terms "BJH pore volume" according to the present invention, it is meant the pore volume as measured by manometry with adsorption of nitrogen at 77 K after degassing under vacuum at a temperature comprised between 150 and 250° C., notably at 190° C. for at least 2 hours and calculated according to the BJH method, using the desorption curve, with the hypothesis of a cylindrical pore geometry.

By the terms "total pore volume" in the present specification, it is meant the BJH pore volume consisting of pores with a diameter smaller than or equal to 1000 Å.

Preferably, the semi-hydrated dolime comprises particles presenting a $d_{10}$ greater or equal to 0.5 μm, in particular about 1 μm.

Moreover, the semi-hydrated dolime comprises advantageously particles presenting a $d_{50}$ comprised between 4 μm and 8 μm.

In particular, the semi-hydrated dolime comprises particles presenting a $d_{97}$ comprised between 40 μm and 95 μm.

The notation dx represents a diameter expressed in μm, measured by laser granulometry in methanol after sonication, relatively to which X % by volume of the measured particles are smaller or equal.

In another embodiment of the present invention, the metallic ore fluxed pellets, in particular iron ore fluxed pellets, contain metallic ore concentrate, in particular iron ore concentrate, presenting particles having a Blaine fineness comprised between 1500 $cm^2/g$ and 2500 $cm^2/g$, preferably between 1800 $cm^2/g$ and 2200 $cm^2/g$.

By the expression "Blaine fineness", it is meant in the meaning of the present specification fineness measured according to the ASTM standard C-204-07 using an air-permeability apparatus and the Test Method A. The Blaine fineness of particles is the specific surface area expressed as the surface area in square centimetres per gram of particles.

In a particularly preferred embodiment according to the invention, the metallic ore fluxed pellets, in particular iron ore fluxed pellets, present a size distribution characterized by 90% to 98% of the pellets presenting a diameter comprised between 8 to 16 mm.

In a particularly preferred embodiment according to the invention, metallic ore fluxed pellets are iron ore fluxed pellets comprising fine iron ore concentrate selected from the group consisting of magnetite, hematite and mixture thereof.

In another embodiment of the present invention, the metallic ore fluxed pellets, in particular the iron ore fluxed pellets further comprise a flux selected from the group consisting of calcium carbonate, dolomite, olivine, pyroxenite, other magnesium silicates, like dunite, and mixture thereof.

Preferably, said flux is between 0.5% and 15% by weight with respect to the total weight of the pellets.

Advantageously, according to the present invention, the metallic ore fluxed pellets, in particular the iron ore fluxed pellets are crude metallic ore fluxed pellets, in particular crude iron ore fluxed pellets.

The moisture content of the pellets is controlled, even in the absence of bentonite, and the mechanical and metallurgical properties of the pellets are enhanced.

The crude metallic ore fluxed pellets are characterized by a crushing strength before drying ("wet pellet") which is comprised between 10 and 30 N per pellet and after drying ("dried pellet") which is comprised between 30 and 90 N per pellet.

The crude metallic ore fluxed pellets according to the present invention present a shock temperature equal to or more than 250° C.

By the terms "shock temperature" it is meant according to the present invention the minimum temperature at which cracks are produced in the wet crude pellets when put inside a hot muffle, directly from room temperature. To this purpose, various samples of crude pellets are submitted individual to gradually increased temperature. Typically, a first sample will be subject to 200° C., a second to 250° C., until cracked pellets are observed in one sample. Those cracks appear very quickly (a few minutes) in the pellets after submission to the setting temperature.

Alternatively, the metallic ore fluxed pellets, in particular the iron ore fluxed pellets according to the present invention are fired metallic ore fluxed pellets, in particular fired iron ore fluxed pellets.

Thanks to the semi-hydrated dolime used as binder in the present invention, the fired pellets presents also enhanced mechanical properties after the hardening process. The crushing strength of the fired pellets according to the present invention measured according to standard ISO 4700 is comprised between 2000 and 5000 N/pellet, preferably comprised between 2500 and 5000 N/pellet.

Moreover, the quality of the fired pellets according to the present invention has been enhanced since the replacement of the minerals contained in the bentonite allows for example the reduction of the volume of slag in the blast-furnace or electric arc furnace after the direct reduction reactor.

Preferably, the fired pellets according to the invention contain less than 10%, in particular less than 5% by weight of $SiO_2$ with respect to the total weight of the pellets.

The total metal, in particular iron, content in the fired pellets is preferably equal to or higher than 55%, in particular equal to or higher than 60%, advantageously equal to or higher than 65% by weight with respect to the total weight of the pellets.

The metallurgical properties of the fired pellets obtained according to the present invention are a reducibility above 0.70%/minute, following the standard ISO 4695, "Determination of the reducibility by the rate of reduction index", below 20% swelling (by buoyancy), following the standard ISO 4698, "Determination of the free-swelling index" and a crushing strength after reduction above 150 N/pellet, following the standard ISO 4696 "Determination of low-temperature reduction-disintegration indices by static method». The use of semi-hydrated dolime containing magnesium hydroxide in a proportion comprised between 0.5 and 19.5% by weight as binder in metallic ore fluxed pellets allows therefore the production of metallic ore fluxed pellets with adequate mechanical properties together with an adequate chemical composition for use in electrical or blast furnace.

Other embodiments of the use according to the invention are mentioned in the annexed claims.

The invention relates also to a process for manufacturing metallic ore fluxed pellets, in particular iron ore fluxed pellets comprising the steps of:

- feeding a fine metallic ore concentrate, in particular a iron ore concentrate in a container;
- feeding a binder in said container;
- adjusting moisture in said container to form a wet mixture;
- balling and sieving said wet mixture into crude metallic ore fluxed pellets, in particular crude iron ore fluxed pellets;

characterized in that said binder is a magnesium-including compound comprising semi-hydrated dolime fitting the general formula $aCa(OH)_2 \cdot bMg(OH)_2 \cdot cMgO$, a, b and c being weight fractions wherein the weight fraction b of $Mg(OH)_2$ is between 0.5 and 19.5% by weight with respect to the total weight of said semi-hydrated dolime.

The balling and the sieving step is preferably performed in a granulating vessel like a drum or disk (pan) which can be the container or not.

The residence time of the wet mixture to form the pellets inside the granulating drum is comprised between 50 and 200 s for pellets presenting a diameter comprised between 8 and 16 mm.

Preferably, the process according to the present invention further comprises the step of hardening the crude metallic ore fluxed pellets, in particular crude iron ore fluxed pellets in an induration furnace.

Said hardening step comprises advantageously the steps of: drying the crude pellets at about 300° C. during a predetermined duration comprised between 5 min and 15 min for forming dried crude pellets;

- pre-heating the dried crude pellets at a temperature equal to or higher than 800° C. during a predetermined duration comprised between 5 min and 20 min for forming pre-heated crude pellets;
- firing the pre-heated crude pellets at a temperature equal to or higher than 1200° C. during a predetermined duration comprised between 5 min and 20 min to form fired metallic ore fluxed pellets, in particular fired iron ore fluxed pellets;

Advantageously, according to the present invention, the step of adjusting moisture is a step of adding an aqueous phase to form said wet mixture.

The step of adding an aqueous phase is preferably a gradual addition of the aqueous phase into the powdered mixture.

Preferably the aqueous phase is water.

Advantageously, according to the invention, the step of adjusting moisture is performed until said mixture presents a moisture content comprised between 5% et 15% by weight with respect to the total weight of said mixture.

In another embodiment of the process according to the invention, crude metallic ore fluxed pellets, in particular crude iron ore fluxed pellets present a size distribution characterized by 90% to 98% of the pellets presenting a diameter comprised between 8 to 16 mm.

Preferably, the process according to the invention further comprises a step of feeding a flux before the step of adjusting moisture, the flux being preferably selected from the group consisting of calcium carbonate, olivine, pyroxenite, other magnesium silicates and mixture thereof.

Preferably, the weight fraction c of MgO is greater than or equal to 5%, preferably greater than or equal to 10%, advantageously greater than or equal to 15%, preferentially greater than or equal to 20% by weight of MgO with respect to the total weight of said semi-hydrated dolime and is less than or equal to 41%, preferably less than or equal to 30% by weight of MgO with respect to the total weight of said semi-hydrated dolime, the weight fraction a of $Ca(OH)_2$ is greater than or equal to 15%, preferably greater than or equal to 30%, advantageously greater than or equal to 40%, preferentially greater than or equal to 45% by weight of $Ca(OH)_2$ with respect to the total weight of said semi-hydrated dolime and is less than or equal to 85%, preferably less than or equal to 65%, advantageously less than or equal to 60%, more preferably less than or equal to 55% by weight of $Ca(OH)_2$ with respect to the total weight of said semi-hydrated dolime.

Advantageously, in the process according to the invention, the binder is added in a quantity comprised between 0.5% and 5%, preferably between 0.5% and 1.5% by weight with respect to the total weight of the pellets.

Alternatively, according to the present invention, the weight fraction of semi-hydrated dolime is between 80% and 100%, preferably between 90% and 100%, more preferably between 95% and 100%, advantageously between 97% and 100%, preferably between 98% and 100% by weight with respect to the total weight of the binder. In a particular embodiment of the invention, the semi-hydrated dolime is 100% by weight with respect to the total weight of the binder.

In the process according to the invention, said fine metallic ore concentrate, in particular iron ore concentrate presents advantageously a Blaine fineness comprised between 1500 $cm^2/g$ and 2500 $cm^2/g$, preferably between 1800 $cm^2/g$ and 2200 $cm^2/g$.

Other embodiments of the process according to the invention are mentioned in the annexed claims.

The present invention relates also to a metallic ore fluxed pellets. In particular iron ore fluxed pellets composition comprising:

- a fine metallic ore concentrate, in particular an iron ore concentrate in a quantity comprised between 80 weight % and 99 weight % with respect to the total weight of the metallic ore fluxed pellets composition;
- a magnesium-including compound as binder in a quantity comprised between 0.1 weight % and 5 weight %, in particular between 0.5 weight % and 1.5 weight % with respect to the total weight of the metallic ore fluxed pellets composition;
- a moisture content comprised between 5 weight % and 15 weight % with respect to the total weight of the metallic ore fluxed pellets composition;

characterized in that the magnesium-including compound comprises a semi-hydrated dolime fitting the general formula $aCa(OH)_2 \cdot bMg(OH)_2 \cdot cMgO$, a, b, and c being weight fractions wherein the weight fraction b of $Mg(OH)_2$ is between 0.5 and 19.5% by weight with respect to the total weight of said semi-hydrated dolime.

Alternatively, according to the present invention, the weight fraction of semi-hydrated dolime is between 80% and 100%, preferably between 90% and 100%, more preferably between 95% and 100%, advantageously between 97% and 100%, preferably between 98% and 100% by weight with respect to the total weight of the binder. In a particular embodiment of the invention, the semi-hydrated dolime is 100% by weight with respect to the total weight of the binder.

Advantageously, the composition according to the invention further comprises from 0.5 weight % to 15 weight % of additives as fluxes with respect to the total weight of the metallic ore fluxed pellets composition.

Preferably, in the composition according to the invention, the weight fraction c of MgO is greater than or equal to 5%, preferably greater than or equal to 10%, advantageously greater than or equal to 15%, preferentially greater than or equal to 20% by weight of MgO with respect to the total weight of said semi-hydrated dolime and is less than or equal to 41%, preferably less than or equal to 30% by weight of MgO with respect to the total weight of said semi-hydrated dolime, the weight fraction a of $Ca(OH)_2$ is greater than or equal to 15%, preferably greater than or equal to 30%, advantageously greater than or equal to 40%, preferentially greater than or equal to 45% by weight of $Ca(OH)_2$ with respect to the total weight of said semi-hydrated dolime and is less than or equal to 85%, preferably less than or equal to 65%, advantageously less than or equal to 60%, more preferably less than or equal to 55% by weight of $Ca(OH)_2$ with respect to the total weight of said semi-hydrated dolime.

In another embodiment of the composition according to the invention, the semi-hydrated dolime comprises particles presenting BET specific surface area obtained from nitrogen adsorption comprised between 5 and 25 $m^2/g$, preferably between 10 $m^2/g$ and 20 $m^2/g$.

Preferably, the semi-hydrated dolime of the composition according to the invention comprises particles presenting a total BJH pore volume consisting of pores with a diameter lower than 1000 Å, obtained from nitrogen desorption comprised between 0.05 and 0.15 $cm^3/g$.

More preferably, the semi-hydrated dolime comprises particles presenting a size characterized either by a $d_{10}$ equal to or greater than 0.5 μm, and/or a $d_{50}$ comprised between 4 μm and 8 μm, and/or a $d_{97}$ comprised between 40 μm and 95 μm.

Alternatively, the metallic ore concentrate, in particular iron ore concentrate presents particles having a Blaine fineness comprised between 1500 $cm^2/g$ and 2500 $cm^2/g$, preferably between 1800 $cm^2/g$ and 2200 $cm^2/g$.

Preferably, the fine iron ore concentrate is selected from the group consisting of magnetite, hematite and mixture thereof.

In a preferred embodiment, the composition according to the invention, further comprises a flux selected from the group consisting of calcium carbonate, dolomite, olivine, pyroxenite, other magnesium silicates, like dunite, and mixture thereof.

Other embodiments of the metallic ore fluxed pellets, in particular iron ore fluxed pellets composition according to the invention are mentioned in the annexed claims.

The present invention relates also to crude metallic ore fluxed pellets, in particular crude iron ore fluxed pellets comprising:

- a fine metallic ore concentrate, in particular an iron ore concentrate in a quantity comprised between 80 weight % and 99 weight % with respect to the total weight of the crude metallic ore fluxed pellets;
- a magnesium-including compound as binder in a quantity comprised between 0.1 weight % and 5 weight %, in particular between 0.5 weight % and 1.5 weight % with respect to the total weight of the crude metallic ore fluxed pellets;
- a moisture content comprised between 5 weight % and 15 weight % with respect to the total weight of the crude metallic ore fluxed pellets;

characterized in that the magnesium-including compound comprises a semi-hydrated dolime fitting the general formula $aCa(OH)_2 \cdot bMg(OH)_2 \cdot cMgO$, a, b, and c being weight fractions wherein the weight fraction b of $Mg(OH)_2$ is between 0.5 and 19.5% by weight with respect to the total weight of said semi-hydrated dolime, said crude metallic ore fluxed pellets.

Alternatively, according to the present invention, the weight fraction of semi-hydrated dolime is between 80% and 100%, preferably between 90% and 100%, more preferably between 95% and 100%, advantageously between 97% and 100%, preferably between 98% and 100% by weight with respect to the total weight of the binder. In a particular embodiment of the invention, the semi-hydrated dolime is 100% by weight with respect to the total weight of the binder.

In particular said crude iron ore fluxed pellets further presenting a crushing strength comprised between 10 and 30 N/pellet.

Advantageously, the crude metallic ore fluxed pellets, in particular crude iron ore fluxed pellets further composes from 0.5 weight % to 15 weight % of additives as fluxes with respect to the total weight of the crude metallic ore fluxed pellets.

Alternatively, according to the present invention, the crude metallic ore fluxed pellets, in particular the crude iron ore fluxed pellets present a shock temperature equal to or higher than 250° C.

Preferably, said crude metallic ore fluxed pellets, in particular said crude iron ore fluxed pellets further present a crushing strength between 30 and 90 N/pellet after drying.

This means that the crude pellets present a crushing strength comprised between 10 and 30 N/pellet before drying, when they are crude wet pellets, and present a crushing strength between 30 and 90 N/pellet after drying, when they are crude dried pellets.

The drying step is performed at about 105° C. during a predetermined duration typically comprised between 12 h and 24 h.

Advantageously, the crude metallic ore fluxed pellets, in particular crude iron ore fluxed pellets according to the invention present a size distribution wherein 90% to 98% of the pellets presents a diameter comprised between 8 to 16 mm.

The crude metallic ore fluxed pellets, in particular crude iron ore fluxed pellets according to the invention comprise advantageously fine iron ore concentrate selected from the group consisting of magnetite, hematite and mixture thereof.

Preferably, the crude metallic ore fluxed pellets, in particular crude iron ore fluxed pellets according to the invention further comprise a flux selected from the group consisting of calcium carbonate, dolomite, olivine, pyroxenite, other magnesium silicates, like dunite, and mixtures thereof.

Advantageously, the crude pellets according to the invention contain metallic ore concentrate, in particular iron ore concentrate presenting particles having a Blaine fineness comprised between 1500 $cm^2/g$ and 2500 $cm^2/g$, preferably between 1800 $cm^2/g$ and 2200 $cm^2/g$.

Other embodiments of crude metallic ore fluxed pellets, in particular crude iron ore fluxed pellets according to the invention are mentioned in the annexed claims.

The present invention relates also to fired metallic ore fluxed pellets, in particular fired iron ore fluxed pellets comprising:

a metal content equal to or higher than 55%, in particular equal to or higher than 60%, advantageously equal to or higher than 65% by weight with respect to the total weight of the pellets, characterized in that the pellets present a Ca/Mg ratio between 0.8 and 2, in particular between 0.8 and 1.7, most particularly between 0.8 and 1.2 and present a crushing strength measured according to standard ISO 4700 comprised between 2000 and 5000 N/pellet, preferably comprised between 2500 and 5000 N/pellet.

In another embodiment of the fired pellets according to the invention, said fired metallic ore fluxed pellets, in particular fired iron ore fluxed pellets contain less than 10%, in particular less than 5% by weight of $SiO_2$ with respect to the total weight of the pellets.

The fired metallic ore fluxed pellets, in particular fired iron ore fluxed pellets according to the invention comprise advantageously fine iron ore concentrate selected from the group consisting of magnetite, hematite and mixture thereof.

Preferably, the fired metallic ore fluxed pellets, in particular fired iron ore fluxed pellets according to the invention further comprise a flux selected from the group consisting of calcium carbonate, dolomite, olivine, pyroxenite, other magnesium silicates, like dunite, and mixture thereof.

In a particularly preferred embodiment according to the invention, the fired metallic iron ore fluxed pellets, in particular fired iron ore fluxed pellets present a size distribution wherein 90% to 98% of the pellets presents a diameter comprised between 8 to 16 mm.

Other embodiments of fired metallic ore fluxed pellets, in particular fired iron ore fluxed pellets according to the invention are mentioned in the annexed claims.

Example

A composition containing the binder according to the invention has been implemented and present the characteristics presented in table 1. In table 1, the weight % are expressed with respect to the total weight of the pellets.

TABLE 1

| | |
|---|---|
| Basicity expressed as ($CaO/SiO_2$) | 0.75 |
| Mg expressed as MgO (weight %) | 1.3 |
| Magnetite (weight %) | 57.4 |
| Hematite (weight %) | 36.6 |
| Limestone (weight %) | 1.2 |
| Dolomite (weight %) | 2.8 |
| Semi-hydrated dolime (weight %) | 1.5 |
| Bentonite (weight %) | 0 |
| Anthracite (weight %) | 0.5 |

The amount of elemental Mg expressed as MgO represents the amount of elemental Mg in the mixture of the different components forming the composition of the pellets.

Limestone and dolomite appear as fluxes. Water is added to composition according to table 1 in order to ball and sieve the resulting wet mixture into crude pellets.

The crude pellets are dried at about 300° C. for forming dried crude pellets. The dried crude pellets are pre-heated at 800° C. for forming pre-heated crude pellets. The pre-heated crude pellets are fired at 1280° C. to form fired pellets. The total cycle time from the drying step to the end of the fifing step is 22.4 minutes and the bed height green balls/hearth layer is 300/100 mm.

The fired pellets present 64.2 weight % of Fe and 4.2 weight % of $SiO_2$ based on the total weight of the fired pellets.

The crushing strength of the fired pellets measured according to the standard ISO 4700 is 3320 N/pellet.

The fired pellets are subjected to a swelling test according to standard ISO 4698 and afterwards the crushing strength of the pellets is measured according to the standard ISO 4700.

Then, the fired pellets are subjected to a reducibility test according to standard ISO 4695 and afterwards the crushing strength of the pellets is measured according to the standard ISO 4700.

Finally, the fired pellets are subjected to a desintegration test according to standard ISO 4696 and afterwards the crushing strength of the pellets is measured according to the standard ISO 4700.

The results of these measurements are shown in table 2.

TABLE 2

| | |
|---|---|
| Crushing strength according to ISO 4700 on pellets after swelling test according ISO 4698 (N/pellet) | 180 |
| Crushing strength according to ISO 4700 on pellets after reducibility test according ISO 4695 (N/pellet) | 420 |
| Crushing strength according to ISO 4700 on pellets after desintegration test according ISO 4696 (N/pellet) | 260 |

A composition containing a binder according to the invention has been implemented and presents the characteristics presented in table 3. In table 3, the weight % are expressed with respect to the total weight of the pellets.

TABLE 3

| | |
|---|---|
| Basicity expressed as ($CaO/SiO_2$) | 0.2 |
| Mg expressed as MgO (weight %) | 1.22 |
| Magnetite (weight %) | 49.5 |
| Hematite (weight %) | 49.5 |
| Binder comprising semi hydrated dolime (weight %) | 1 |

The amount of elemental Mg expressed as MgO represents the amount of elemental Mg in the mixture of the different components forming the composition of the pellets.

The composition above comprises 0.6 weight % of coke and 1.52 weight % of olivine both expressed with respect to the sum of the weight of hematite and magnetite.

The binder composition comprising semi hydrated dolime is presented in table 4, wherein the weight % are expressed with respect to the total weight of the binder.

TABLE 4

| | |
|---|---|
| Mg(OH)2 (weight %) | 1.24 |
| Ca(OH)2 (weight %) | 57.41 |
| CaCO3 (weight %) | 2.84 |
| CaO (weight %) | 4.2 |
| MgO (weight %) | 33.1 |
| Fe2O3 (weight %) | 0.42 |
| Other impurities (weight %) | 0.79 |

Water is added to the composition in order to ball and sieve the resulting wet mixture into crude pellets.

The crude pellets are dried at about 300° C. for forming dried crude pellets. The dried crude pellets are pre-heated at 800° C. for forming pre-heated crude pellets. The pre-heated crude pellets are fired at 1270° C. to form fired pellets. The total cycle time from the drying step to the end of the firing step is 27.4 min and the bed height green balls/hearth layer is 300/100 mm.

The fired pellets presents 66 weight % of Fe and 2.95 weight % of $SiO_2$ based on the total weight of the fired pellets.

The crushing strength of the fired pellets measured according to the standard ISO 4700 is 2920 N/pellet.

The fired pellets are subjected to a swelling test according to standard ISO 4698 and afterwards the crushing strength of the pellets is measured according to the standard ISO 4700.

The fired pellets are subjected to a reducibility test according to standard ISO 4695 and afterwards the crushing strength of the pellets is measured according to the standard ISO 4700.

Finally the fired pellets are subjected to a disintegration test according to standard ISO 4696 and afterwards the crushing strength of the pellets is measured according to the standard ISO 4700.

The results of these measurements are shown in table 5.

TABLE 5

| | |
|---|---|
| Crushing strength according to ISO 4700 on pellets after swelling test according ISO 4698 (N/pellet) | 300 |
| Crushing strength according to ISO 4700 on pellets after reducibility test according ISO 4695 (N/pellet) | 310 |
| Crushing strength according to ISO 4700 on pellets after disintegration test according ISO 4696 (N/pellet) | 210 |

Comparative Example

A composition containing bentonite as binder has been implemented and present the characteristics presented in table 6. In table 6, the weight % are expressed with respect to the total weight of the pellets.

TABLE 6

| | |
|---|---|
| Basicity expressed as ($CaO/SiO_2$) | 0.75 |
| Mg, expressed as MgO (weight %) | 1.3 |
| Magnetite (weight %) | 56.1 |
| Hematite (weight %) | 36.3 |
| Limestone (weight %) | 1.8 |
| Dolomite (weight %) | 4.7 |
| Semi-hydrated dolime (weight %) | 0 |
| Bentonite (weight %) | 0.6 |
| Anthracite (weight %) | 0.5 |

The amount of elemental Mg expressed as MgO represents the amount of elemental Mg in the mixture of the different components forming the composition of the pellets.

Limestone and dolomite appear as fluxes. Water is added to composition according to table 6 in order to ball and sieve the resulting wet mixture into crude pellets.

The crude pellets are dried at about 300° C. for forming dried crude pellets. The dried crude pellets are pre-heated at 800° C. for forming pre-heated crude pellets. The pre-heated crude pellets are fired at 1280° C. to form fired pellets. The total cycle time from the drying step to the end of the firing step is 22.4 minutes and the bed height green balls/hearth layer is 300/100 mm.

The fired pellets present 63.7 weight % of Fe and 3.5 weight % of $SiO_2$ based on the total weight of the fired pellets.

The crushing strength of the fired pellets measured according to the standard ISO 4700 is 2410 N/pellet.

The fired pellets are subjected to a swelling test according to standard ISO 4698 and afterwards the crushing strength of the pellets is measured according to the standard ISO 4700.

Then, the fired pellets are subjected to a reducibility test according to standard ISO 4695 and afterwards the crushing strength of the pellets is measured according to the standard ISO 4700.

Finally, the fired pellets are subjected to a desintegration test according to standard ISO 4696 and afterwards the crushing strength of the pellets is measured according to the standard ISO 4700.

The results of these measurements are shown in table 7.

TABLE 7

| | |
|---|---|
| Crushing strength according to ISO 4700 on pellets after swelling test according ISO 4698 (N/pellet) | 110 |
| Crushing strength according to ISO 4700 on pellets after reducibility test according ISO 4695 (N/pellet) | 260 |
| Crushing strength according to ISO 4700 on pellets after desintegration test according ISO 4696 (N/pellet) | 150 |

As it can be seen from tables 2, 5 and 7, the crushing strengths of the fired pellets made from the composition according to the present invention are well above the one of the pellets containing bentonite as binder.

The invention claimed is:

1. A process for manufacturing metallic ore fluxed pellets, comprising the steps of:

feeding a fine metallic ore concentrate into a container, wherein said fine metallic ore concentrate presents a Blaine fineness comprised between 1500 $cm^2/g$ and 2500 $cm^2/g$;

feeding a binder in said container;

adjusting moisture in said container to form a wet mixture;

balling and sieving said wet mixture into crude metallic ore fluxed pellets;

wherein said binder is a compound which includes magnesium, the compound comprising a semi-hydrated dolime fitting the general formula $aCa(OH)_2 \cdot bMg(OH)_2 \cdot cMgO$, a, b and c being weight fractions wherein the weight fraction b of $Mg(OH)_2$ is between 0.5 and 19.5% by weight with respect to the total weight of said semi-hydrated dolime.

2. The process of claim 1, further comprising a firing step for hardening the crude metallic ore fluxed pellets in an induration furnace.

3. The process of claim 2, wherein said firing step comprises the steps of:

drying the crude metallic ore fluxed pellets at 300° C. during a predetermined period of time comprised between 5 min and 15 min for forming dried crude pellets;

pre-heating the dried crude metallic ore fluxed pellets at a temperature equal to or higher than 800° C. during a predetermined period of time comprised between 5 min and 20 min for forming pre-heated crude pellets;

firing the pre-heated crude metallic ore fluxed pellets at a temperature equal to or higher than 1200° C. during a predetermined duration comprised between 5 min and 20 min to form fired metallic ore fluxed pellets.

4. The process of claim 1, wherein the step of adjusting moisture is a step of adding an aqueous phase to form said mixture.

5. The process of claim 1, wherein the step of adjusting moisture is performed until said mixture presents a moisture content comprised between 5% et 15% by weight with respect to the total weight of said mixture.

6. The process of claim 1, further comprising a step of feeding a flux before the step of adjusting moisture, the flux being preferably selected from the group consisting of calcium carbonate, olivine, pyroxenite, other magnesium silicates and mixture thereof.

7. The process of claim 1, wherein the weight fraction c of MgO is greater than or equal to 5% by weight of MgO with respect to the total weight of said semi-hydrated dolime and is less than or equal to 41% by weight of MgO with respect to the total weight of said semi-hydrated dolime, and wherein the weight fraction a of $Ca(OH)_2$ is greater than or equal to 15% by weight of $Ca(OH)_2$ with respect to the total weight of said semi-hydrated dolime and is less than or equal to 85% by weight of $Ca(OH)_2$ with respect to the total weight of said semi hydrated dolime.

8. The process of claim 1, wherein the weight fraction of said binder is between 0.5% and 5% by weight with respect to the total weight of the pellets.

* * * * *